United States Patent [19]

Timms

[11] Patent Number: 4,875,686

[45] Date of Patent: Oct. 24, 1989

[54] ELECTRONIC BINGO GAMES SYSTEM NETWORK AND COMPONENTS THEREFOR

[76] Inventor: Herbert Timms, Caixa Postal 1322 Campinas, Sao Paulo, Brazil, 13.100

[21] Appl. No.: 120,373

[22] Filed: Nov. 13, 1987

[51] Int. Cl.[4] ..... A63F 3/06

[52] U.S. Cl. ..... 273/237; 273/269

[58] Field of Search ..... 273/1 E, 85 G, 237, 273/238, 269, 138 A; 364/410–412

[56] References Cited

U.S. PATENT DOCUMENTS

| | | | |
|---|---|---|---|
| 4,339,798 | 7/1982 | Hedges et al. | 273/138 A |
| 4,732,392 | 3/1988 | Kerr et al. | 273/269 |
| 4,747,600 | 5/1988 | Richardson | 273/138 A |

FOREIGN PATENT DOCUMENTS

| | | | |
|---|---|---|---|
| 2153189 | 8/1985 | United Kingdom | 273/85 G |

*Primary Examiner*—Leo P. Picard

*Attorney, Agent, or Firm*—Oldham & Oldham Co.

[57] ABSTRACT

An electronic bingo game system is shown comprising player table units electronically interconnected with a master control station, and a cashier station. Players utilizing the system insert specially indented tokens in slots in their table unit, and manipulate controls to indicate their wagers, or to discontinue play. The master control station selects random bingo numbers, tracks player credits, issues payment orders, communicates with other stations as required, and performs other game related functions. The indented tokens employed with the system are received in an anti-theft chute where they are optically scanned to determine their value, based on their light transmission, establishing a player's credit. Also shown in connection with the system's number displays are devices for enhancing LED produced light.

8 Claims, 4 Drawing Sheets

FIG.-6
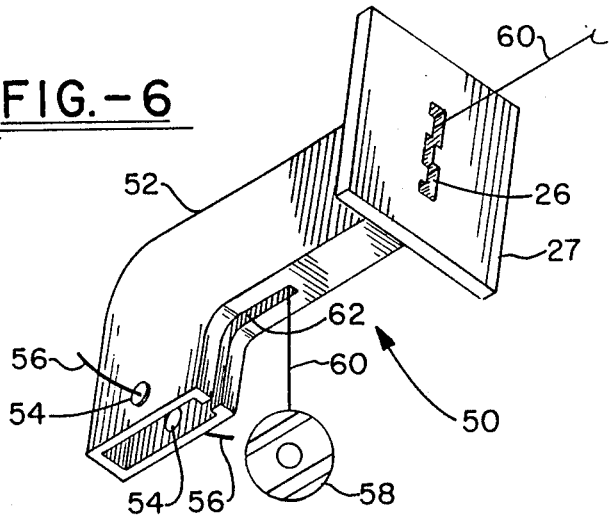
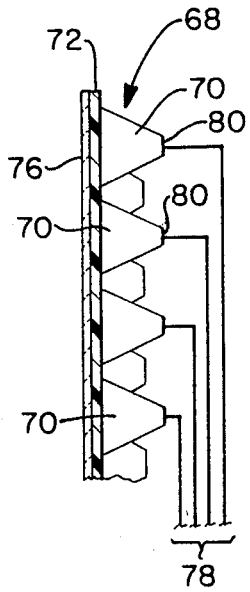
FIG.-10
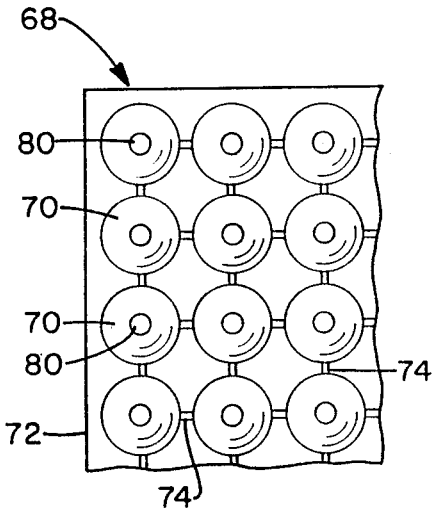
FIG.-11

ELECTRONIC BINGO GAMES SYSTEM NETWORK AND COMPONENTS THEREFOR

TECHNICAL FIELD

This invention relates to automated game systems. More particularly, this invention relates to an electronic game system network, and to the various components required therefor. Specifically, this invention relates to electronic components, and to their interconnection in a network which permits multi-player participation in, and wagering on automated bingo games.

BACKGROUND OF THE INVENTION

Wagering and games of chance have been an object of fascination to large segments of the population since the dawn of history. The game of bingo is one such game, which perhaps because of its simplicity and the prolongation of player suspense, has continued to attract large numbers of participants year-after-year. The game is played by providing players with cards having a matrix of numbers printed thereon, and means, frequently covering markers, for identifying which of such numbers have been randomly selected and notified to the players by the game's operator. Winners are determined by the first player holding a bingo card with called numbers arranged thereon in a prescribed pattern. Players become aware of having achieved such predetermined patterns on their boards by covering called numbers with the markers, directing attention of a completed pattern to the operator. A number of games are played during the gaming session, and the operator of the game typically charges players for their participation, returning a portion of the charge to winning players, and retaining the rest to cover expenses and profit. Generally, the more games played in a given space of time, the greater the profit realized by the operator, who understandably is, therefore, anxious to complete as many games as possible during the gaming session.

Unfortunately, the collection of money from the players, the repeated drawing of random numbers, their announcement to the players, and the confirmation of selected numbers on the winner's cards is a relatively lengthy process. Furthermore, the process is quite labor intensive, subject to mistakes, and appreciable time is required to complete the games, creating substantial operating expenses, and correspondingly reducing profits.

In order to overcome such problems, and to make the game more attractive, a number of attempts have been made to automate the game, for example, by supplying players with semiautomated display board devices. Some of these facilitate the covering of called numbers through the process of pressing digital entry buttons on electric terminals, triggering the display of called numbers in spaces on display boards. Other devices are operated by sliding covers over numbered windows representing spaces on the bingo board, or utilize similar expedients to facilitate play. Sometimes the semiautomated systems even include an operator unit which has the ability to tally coins wagered. While a few such devices provide limited advantages over previous systems, up to now, a fully automated system for playing bingo has never been devised. Furthermore, automated systems activated through the insertion of coins by the players have encouraged, and been vulnerable to fraud through the use of counterfeit coins, retrievable coins, and by similar and different artifices. In addition, coin-operated devices are normally subject to frequent breakdown, requiring continuing, costly maintenance, and the devices have various other disadvantages.

DISCLOSURE OF THE INVENTION

In light of the foregoing, therefore, a first aspect of the invention is to provide an automated bingo game which allows more games to be played during a given gaming session than would be possible by other methods.

A second aspect of this invention is to allow bingo games to be played, and winners to be confirmed, without error.

Another aspect is to permit wagers to be placed by players at their seats, without involvement of other parties.

A further aspect of the invention is to provide player consoles activated by tokens proprietary to the game's operator, whose value can be changed whenever desired.

An additional aspect of the invention is the provision of an electronic bingo game system network which permits the operator to audit game events, statistics, and other related matters from a master control station.

Yet another aspect of the invention is provision of token receivers which make it possible to detect the insertion of bogus tokens, to automatically determine the value of genuine tokens by photoelectronic means, and to accomplish the preceding without mechanical processing.

A still further aspect of the invention is to provide token receivers that defeat attempts to withdraw inserted coins after they have been used to activate the player console.

Another aspect of the invention is to provide means for magnifying the illumination supplied by LED's used for display purposes.

Yet another aspect of this invention is to provide the automatic calculation of paramutual wagering information and the distribution of credits to winning players, together with a current status of their gaming account.

An additional aspect of the invention is the provision for automated printing of payment orders to the game's cashier for players wishing to discontinue play.

The foregoing and other aspects of this invention are provided by an electronic bingo game system network comprising in combination:

a master control station circuit;

table relay station circuits;

player table station circuits, and a cashier station circuit, said station circuits being electronically interconnected, wherein said master control station circuit has certain electronic abilities, including the ability to sequentially select random bingo game numbers and to transmit said numbers to said player station circuits through said table station circuits, and wherein said player table station circuits have electronically programmed visual displays representing bingo cards with uniquely numbered bingo matrices, said player table station circuits also having certain electronic abilities, including the ability to transmit through said table station circuits to said master control station circuit the amount of wagers placed by the insertion of tokens and the operation of controls associated with said player table station circuits, as well as the first completion of a predetermined winning pattern of said selected numbers, said master control station circuit also having the ability to verify the occurrence of said completion, to calculate the winnings due therefor on a paramutual basis, as well as to determine the status of players' accounts, and the ability to transmit totals due players to said cashier circuit upon request of players electronically transmitted from the player table station circuit.

The foregoing and further aspects of the invention are provided by an electric bingo game system network with interconnected electronic components comprising:

a master control station;
dual module player table stations;
table relay stations, and
a cashier station, wherein said master control station comprises a display board, and a control board, said display board comprising:

a microcontroller;
an LED driver circuit;
an LED display;
a serial transmission circuit, and
a power-up circuit, said control board comprising:
a microcontroller;
a command switch driver circuit;
a memory circuit;
a serial transmission circuit, and
a power-up circuit,
and wherein said player table relay station comprises:
a microcontroller;
a serial transmission circuit, and
a power-up circuit,
and wherein further, said dual module player table stations comprise:
a microcontroller;
dual token scanner circuits;
dual analog to digital conversion circuits;
dual scanner calibration circuits;
dual player control circuits;
dual player identification circuits;
a serial transmission circuit;
an LED display driver circuit;
dual LED displays, and
a power-up circuit,
and wherein still further, said cashier station comprises:
a printer, and
a printer driver circuit.

The foregoing and other aspects are provided by a token receiver comprising in combination:

an indented token slot;
an angled token chute, and
token scanner means, wherein said token slot is configured to only allow coin-shaped tokens with compatible indentations to pass therethrough, and wherein said token chute has a hollow, rectangular, transverse cross-section adapted to allow the passage of indented tokens inserted through said slot, and wherein further, said chute has a substantially hockey stick shape when viewed at right angles to its longitudinal axis, a first portion of said chute representing the handle of said stick, said first portion being attached to, and angled downward from said token slot, and a second portion of said chute representing the blade of said stick, said second portion being connected with, and extending vertically downward from said first portion, and wherein still further, said token scanner means is located in said angled chute.

The foregoing and additional aspects of the invention are provided by an indented token for use in connection with the token receiver of the preceding paragraph which comprises a coin-shaped token made with pigmented plastic, at least part of said token having some transparency to light, the sides of said token being indented with a series of parallel grooves extending from one edge of said token, to its opposite edge, said token also having a circular indentation in the center of one of its sides.

The foregoing and still other aspects of the invention are provided by an LED reflecting device comprising a plurality of truncated, hollow, metalized reflector cones aligned in the same plane, said cones being positioned and interconnected to form a pattern, each of said cones having a hole at its apex adapted for the insertion of an LED therein, while the base of said cones is covered with a translucent film.

BRIEF DESCRIPTION OF THE DRAWINGS

The invention will be better understood when reference is had to the drawings, wherein like numbers refer to like parts.

FIG. 6 shows an isometric view of a token receiver of the invention, generally, defeating the attempted use of a retrievable token.

FIG. 10 shows a broken-away side elevation of an LED reflecting device of the invention, generally.

FIG. 11 shows a plan view of the LED reflecting device of FIG. 10.

BEST MODE FOR CARRYING OUT THE INVENTION

Figure 1:
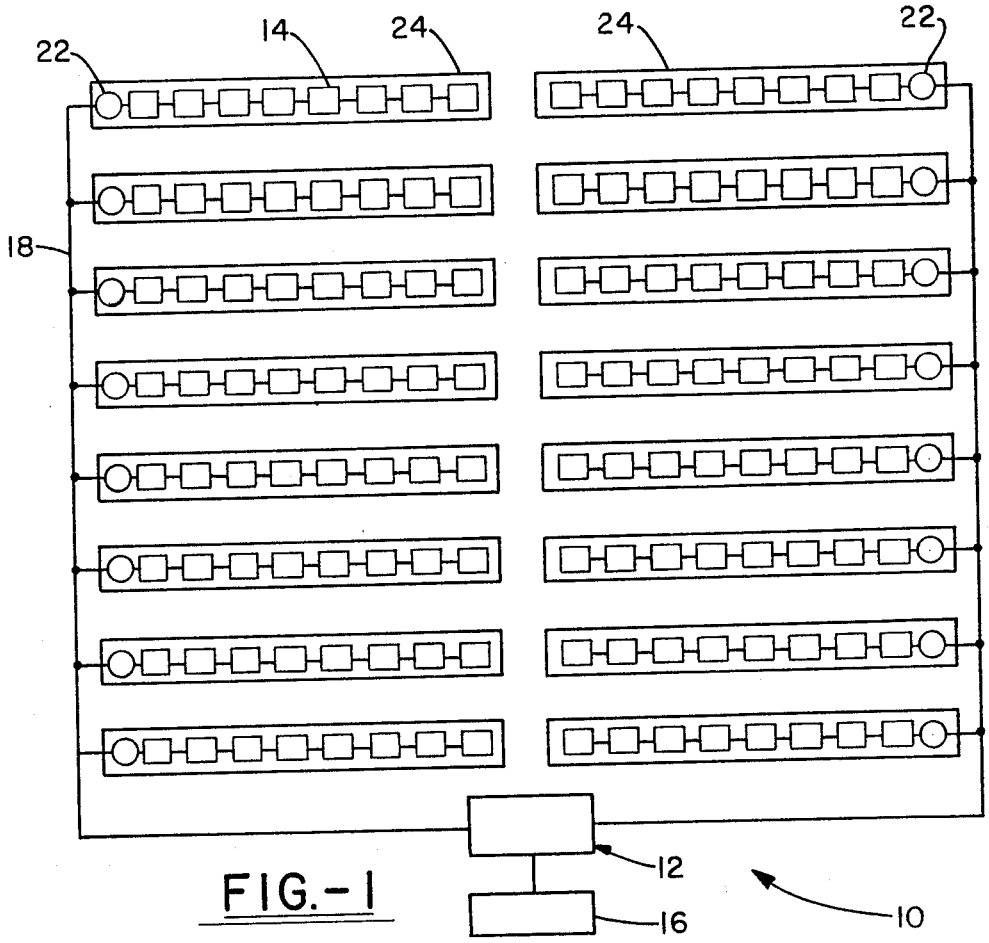
FIG. 1 is a semischematic diagram of an electronic bingo game system network of the invention.

FIG. 1 is a semi-schematic diagram of an electronic bingo game system network of the invention, generally illustrated by the numeral 10. In the Figure, groups of dual module player table stations 14, together with table relay station units 22 are supported on player tables 24. The dual module player table stations 14 on any given table are individually connected to the table relay station unit 22 on that table, which in turn, is connected to master control station 12. The master control station 12 is connected to cashier station 16, all connections and interconnections being represented by a wiring harness, which in the Figure, is illustrated by lines 18.

While different numbers of dual module player table stations 14 may be individually connected to a table relay station unit 22, the connection of dual module player table station units in multiples of 8, for example, 8, 16, 32, etc., facilitates the interconnection and circuits involved in the electronic bingo game system network 10, and such multiples are therefore preferred.

As will become clearer in the following description of the electronic components and circuits involved, the game process comprehends the insertion of an indented token in a token slot provided in one of the modules of the player table stations 14. Such action activates the module and establishes a credit in favor of the player, any portion of which he may elect to wager by activating a wager unit "multiplier" control. After the wagers are placed, random numbers are automatically selected at the master control station and transmitted to an LED display board located in the player table station modules. Numbers are transmitted in sequence, i.e., one after another, until one of the player table station module displays, which are preprogrammed with unique combinations and patterns of numbers in their matrix spaces, has received number signals from the master control station representing a winning display. Following a win, the master control station typically notifies the winning player table station module by ringing a buzzer and/or flashing lights thereon. The master control station also verifies that the numbers called match the pattern on the preprogrammed display matrix of the player table station module, and calculates the amount of winnings due the player on a paramutual basis, crediting the winnings to the player's account. In accordance with the paramutual system, the winnings are determined by the amount of money wagered by all the players, less an amount representing the game operator's share. The random numbers are selected at a rate of about 1 each second, with a typical game lasting until 12 to 13 numbers have been called. Winning patterns can be predetermined by the game's operator, and controlled at the master control station, common winning patterns involving completed diagonal, horizontal, or vertical lines of called numbers across the display matrix, the calling of all number on a display matrix, or other selected patterns. A player signals a desire to discontinue play by activating a game terminator control button on his player table station module His decision is electronically notified to the master control station which, in turn, transmits a signal to the cashier station printer which immediately prints two pressure-sensitive adhesive labels. One of these is placed on a card which is delivered to the appropriate player, while the other is retained by the cashier. Cash representing the status of a player's account is tendered to the player by the cashier upon presentation of the card delivered to him, which has the pertinent account data printed thereon.

Figure 2:
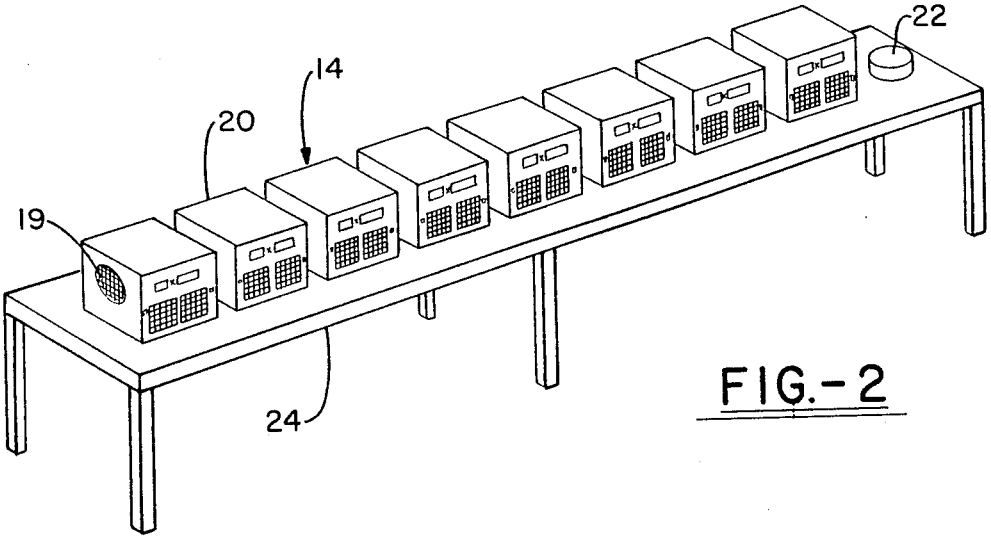
FIG. 2 is a perspective view of a representative player table with player table station consoles, together with a table relay station unit arrayed thereon.

FIG. 2 shows a perspective view of a representative player table 24 on which eight player table station consoles 20, equipped with ventilator grids 19 for interior cooling purposes, are disposed, together with a table relay station unit 22 which functions as a relay station between the table station consoles 20, and the master control station Each of the dual module player table stations 14 comprise dual modules, one on each side of the console, which accommodate two players, one on each side of the table. Each module contains duplicate controls, displays, token receivers, etc., allowing each to be played independently of the other. Each of the dual module player table stations 14 contains integrated circuitry connected to table relay station unit 22 commonly by a wiring harness entering the console from underneath, the interconnecting harness being disposed beneath the table 24. If desired, single rather than dual modules could be provided, and while eight of the consoles 20 are positioned on the table 24, more than that number could be placed thereon as previously suggested.

Figure 3:
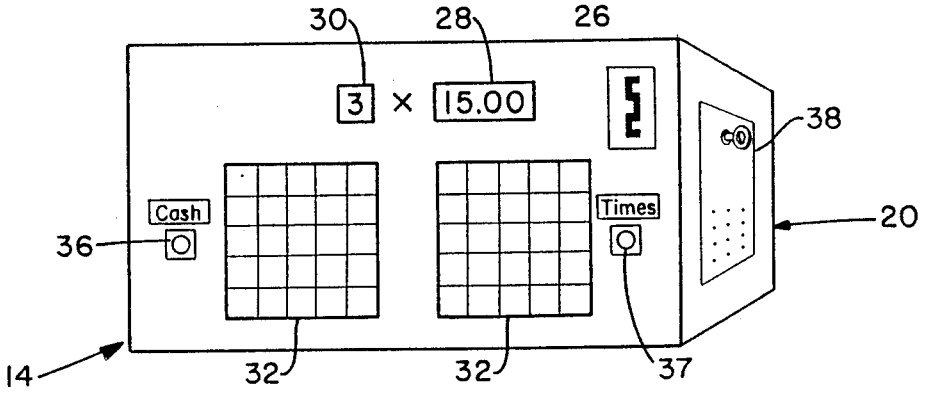
FIG. 3 shows an enlarged perspective view of a player table station console of the invention.

FIG. 3 illustrates an enlarged perspective view of a console, generally 20, used in connection with a dual module player table station 14. The console 20 features an indented token slot 26, the insertion of an indented token through which causes the available credit display 28 to indicate the credits represented by the token. At the appropriate time, indicated by a signal from the master control station 12, usually by means of a flashing light, the player depresses wager unit multiplier control button 37, one time for each of the times he wishes to increase the number of basic wager units he wishes to play. In other words, a basic wager unit is established by the master control station, for example, one dollar. A player wishing to bet three dollars simply depresses the button 37 three times, causing the number three to appear in the wager multiplier display 30 Should the player only wish to wager the standard wager unit, he merely refrains from depressing button 37, causing only a single unit to be bet. At the same time, the credit appearing in the available credit display 28 is reduced by the amount of the wager. After wagers have been thus placed, numbers randomly selected by the master control station 12 begin to appear in the bingo card display matrices 32. When one of the players has achieved the winning pattern on one of his display matrices, the game is automatically terminated, his good fortune is indicated to him not only by completion of the winning pattern on the display, but typically, also by flashing lights, and a ringing buzzer or bell Following computation of the paramutual winnings as previously described, an appropriate adjustment is made in the available credit display 28, appropriate to his winnings. When the player wishes to discontinue the game, he merely pushes the game terminator control button 36, which conveys such information to the master control station, which in turn, notifies the cashier station as previously indicated. As may be inferred from the preceding, the sole actions available to a player are the insertion of tokens, the selection of the wager multiplier, and the indication of a desire to discontinue betting. Tokens inserted into the console 20 are deposited in a locked token depository 38 where they are available for collection only by the game's operator, any unauthorized attempt to open the depository being electronically notified to the master control station.

Figure 4:
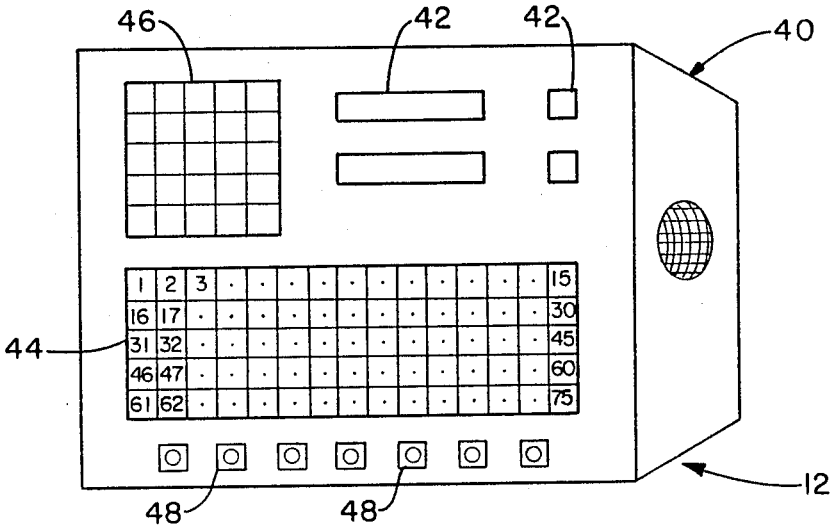
FIG. 4 is a perspective view of a master control station console, generally.

FIG. 4 is a perspective view of a master control station, generally 40, used in connection with a master control station 12. The console 40 is equipped with a bingo board display 46 of the same type appearing on the player table station consoles 20, on which the winning pattern is displayed. In addition, console 40 includes a display for the numbers randomly selected 44, as well as miscellaneous game information displays, 42. The console is also provided with a series of system command switch buttons 48, the depression of which results in, for example, an indication in displays 42 of such things as the winning player, the amount of tokens collected, the content of the token depositories within player consoles, system diagnostics, and a variety of other information, the recall of which may be programmed into the master control station circuitry.

Figure 5:
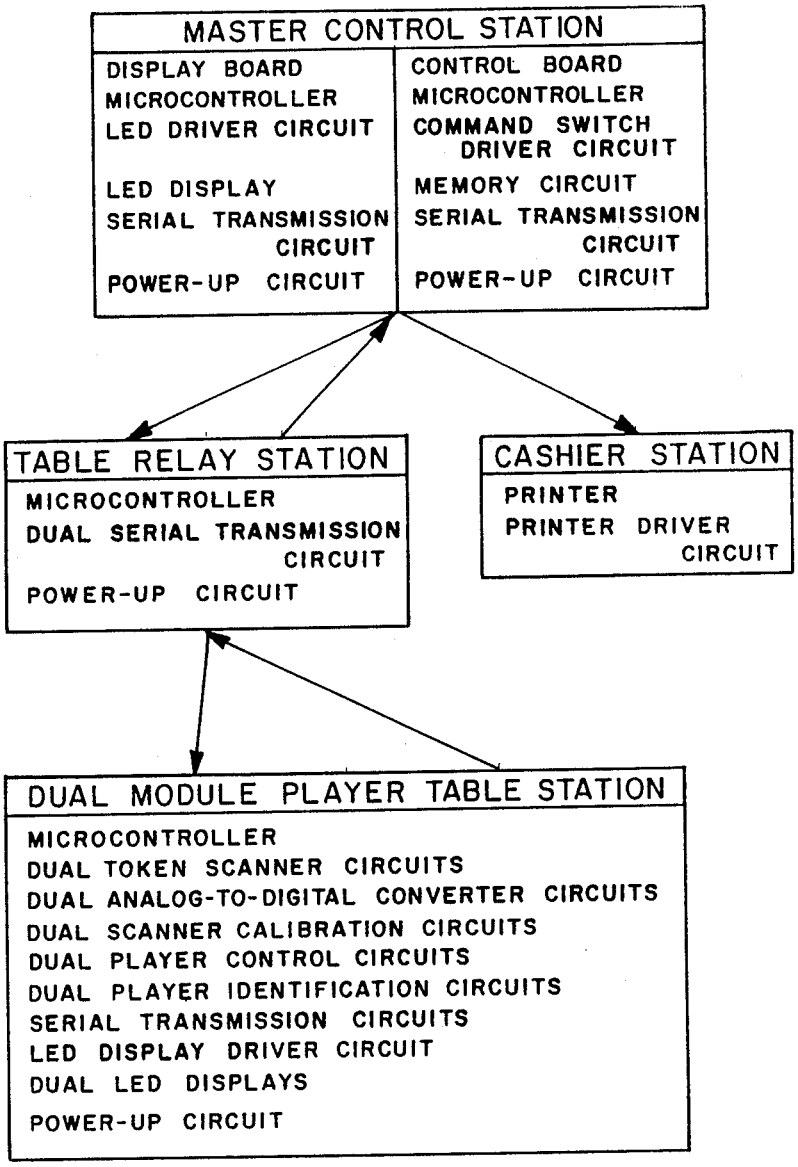
FIG. 5 is an algorithim illustrating the bingo game system network, and the electronic interconnection of component circuits for processing and transmitting game related signals.

FIG. 5 is an algorithm illustrating the bingo game system network, and the electronic interconnection of component circuits required for processing and transmitting game related signals. The various essential game stations are controlled by station circuits which themselves include component subcircuits which interact to perform the function of the station. In turn, the stations themselves interact with one another, transmitting information back and forth between themselves in performing the functions necessary to conduct the game. Considerable latitude is available in designing details of the circuits and subcircuits; however, certain essential components must be included if the overall network is to properly perform necessary game functions. In this connection, it is necessary that the dual analog to digital conversion circuits, which form part of the dual module player table station, contain a printed circuit "chip" equivalent to an ADC0804 designation, employed by National Semiconductor, in C. to describe a chip having the ability to convert analog data to digital data, or an equivalent chip. Similarly, all serial transmission circuits employed in the various stations, instrumental in identifying signal source, contain a chip designated DS3695, employed by National Semiconductor, In C., used in the identification or "addressing" of data in data transmission, or an equivalent chip.

In the Figure, particularly with respect to the master control station, the station includes two basic circuit "boards", a display board and a control board. The display board includes a micro-controller programmed to control the display board circuit. The display is advantageously of the light emitting diode, LED, type, which in addition to the LED display itself, requires an LED driver circuit, a power-up circuit to supply power to the board, and a serial transmission circuit to receive display data from the electronic game network. The control board includes a programmed micro-controller; command switch driver circuits, required to energize the switches; a memory circuit in which game information, rules, and other pertinent data are stored; as well as a serial transmission circuit through which identified data is sent and received by the control board; and a power-up circuit for supplying power to the control board.

The table relay station forms the interface between the master control station and a group of dual module player table stations, controlling, i.e., prioritizing and directing data to and from system stations. In performing such function, the table relay station makes use of a micro-controller and dual serial transmission circuits, in addition to a power-up circuit.

The dual module player table station also contains a micro-controller programmed to perform its assigned functions, as well as dual token scanner circuits, described more completely below, which assist in the examination of inserted tokens. Such information is converted from an analog to a digital form by a dual analog to digital conversion circuit, and the scanning circuits are continuously adjusted to appropriate sensitivity levels by the scanner calibration circuits. Each dual module player table station is also provided with dual player control circuits to allow effectuation of player decisions, and dual player identification circuits to assure the proper addressing of data so that its source and designation are known to the other involved network stations The dual module player table station also contains dual LED displays, an LED display driver circuit, and a power up circuit.

The cashier's station is equipped with a printer and printer driver circuit to enable player payment information to be processed.

In addition to being connected to a main power source, the various station microcontrollers in the system network are also connected to auxillary battery power to allow them to retain their functioning despite a failure of the primary power supply.

FIG. 6 shows an isometric view of a token receiver, generally 50, of the invention defeating the use of a retrievable token. The Figure shows the token receiver 50, which includes an indented token slot 26 in a face plate 27, the latter being attached to an angled chute 52 which has a theft defeat slot 62 disposed in the bottom thereof. Token scanner elements 54, attached to wires 56 are located opposite each other in the sides of the chute so that tokens passing through the chute are disposed at right angles to the scanning light path between such elements. One notorious way in which theft can be committed against a device activated by a token or coin is to secure a thin wire or string to the token by means of which it may be withdrawn after it has been inserted into a slot provided for the purpose in the device, the device thereby being activated. The token receiver 50 of the Figure defeats this strategem through provision of the theft defeat slot 62 which allows the theft string 60 attached to the coin to locate itself in the slot, preventing the coin from being withdrawn due to the narrowness of the slot.

The token scanner elements 54, for example, comprise an infrared emitting LED on one side of the chute, and a matched photoelectric sensor, such as a transistor, located on the other side of the chute, opposite the LED. As the token 58 passes between token sensor elements 54, thus interrupting the light path between them, electrical characteristics, such as the voltage, of the sensor circuit are affected, conveying information regarding the token to appropriate circuits within the system. When the theft defeat slot 62 forms part of the token receiver 50, scanner elements 54 will be located past the point at which the theft defeat slot 62 is located in order to prevent activation of the scanner circuit at a point at which the token 58 can still be withdrawn. Considering the shape of angled chute 52 to be that of a hockey stick when viewed at right angles to its longitudinal axis, the theft defeat slot will extend from about the longitudinal midpoint of the portion of the chute representing the handle of the stick, and will extend downward to the end of the portion of the chute representing the stick's blade. While the photosensitive scanner system described is particularly useful in connection with the electronic bingo game system network of the invention, it may also be used in connection with other devices operated by coin-like tokens. Furthermore, the scanner system described is superior to coin-operated devices, since it eliminates the need for the relatively complex and high maintenance mechanical components normally associated with the handling and verification of coins.

Figure 7:
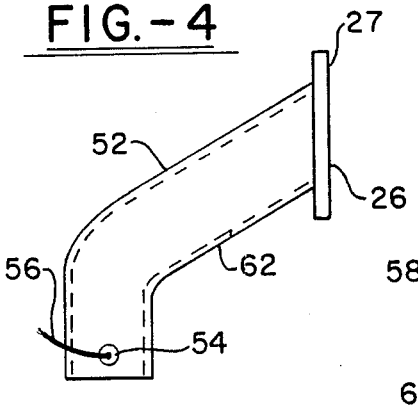
FIG. 7 is a side elevation of a token receiver of FIG. 6.

FIG. 7 is a side elevation of the token receiver 50 of FIG. 6 showing the indented token slot 26 in face plate 27, the angled chute 52, containing the theft defeat slot 62, and one of the token scanner elements 54, attached to electrical connection 56. Considering the handle portion of the hockey stick shaped chute 52 as a first portion, and the blade portion as a second portion, and while other dimensions may be successfully employed, it has been found to be of advantage to provide a chute whose first portion is from about 2 to 4 inches long, in combination with the second portion, the latter having a length of about ½ to 1½ inches. The angle of the first portion of chute 52 need only be steep enough to assure passage of the token along the chute by gravity; consequently, the angle may be varied within a fairly broad range. Normally, however, the chute will be angled downward from the horizontal at from about 15 to 30 degrees.

As previously indicated, and as will be described in greater detail below, the token scanner system determines the character of the token, including its genuineness and value, by electrical characteristics, including voltage variations, resulting from light patterns resulting from changing values of light transmitted as the token passes between the scanner elements. Such values may be determined emperically by noting the patterns resulting from passage of a token past the scanner elements during repeated trials. Typically, for example, a coin whose value is to be determined is passed through the chute and the scanner system contained therein a large number of times, commonly from 50 to 100 times. The electrical patterns resulting from the patterns of light transmitted are measured during such trials, and acceptable parameters established which are programmed into the appropriate system circuits. Thereafter, the system is able to recognize when such a token is processed, assigning a proper value to it.

Figure 8:
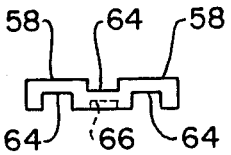
FIG. 8 is a side elevation of an indented token on the invention.

FIG. 8 is a side elevation of an indented token of the invention 58 showing token grooves 64, and a circular indentation 66. Scannable light patterns of the token may be varied by the color, and intensity of color of the token, the number and location of indentations, including grooves and other indented features, the token's thickness and the like. Once identification of the token's light transmission patterns is established by such variations, its value can be set or reset by adjustment of reprogrammable circuit components.

Figure 9:
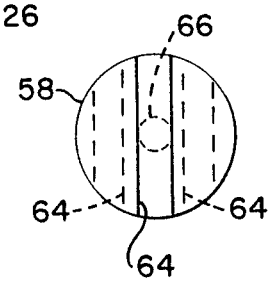
FIG. 9 is a plan view of the indented token of FIG. 8.

FIG. 9 is a plan view of the indented token 58 of FIG. 8 again showing the token grooves 64, and the circular indentation 66. While other sized tokens may be employed, the use of tokens 58 having a diameter of from about ¾ to 1 inch and a thickness of about ⅛ inch approximate the dimensions of a typical coin, and are convenient to use. Tokens having such dimensions and the disposition of grooves and circular indentation shown lend themselves particularly well to the scanning process, as well as to shape restricted insertion through indented token slot 26, and their use is, therefore, particularly advantageous. Tokens made from any of various materials capable of transmitting light are suitable for purposes of the invention; however, plastics are particularly suitable for fabricating tokens, including such plastics as PVC, polyethylene, polypropylene, nylon and others. The use of nylon, particularly that reinforced with fiberglass, and including any of various color pigments, has been found to produce an excellent, long-lasting token, and is highly desirable for those and other reasons.

FIG. 10 shows a broken away side elevation of an LED reflecting device of the invention, generally 68, including truncated hollow reflector cones 70 fastened together in a patterned matrix by reinforcement partitions 74 and a base plate 72. The reflector cones 70 are provided with holes 80 near the apex thereof through which LED's connected to activating wiring 78 are inserted. The base of the cones are covered with a translucent film 76. While LED's are long lasting light sources requiring minimal activating current, they have the disadvantage of providing only limited light values. It has been found that this difficulty can be overcome by mounting the LED's in the reflector cones 70, which are provided with a highly reflective surface such as a metalized surface. The light produced by the LED reflecting device 68 can thereby be greatly enhanced, and at the same time suitably diffused by the provision of the translucent film 76.

The dimensions of the cones may be altered as desired; however, it has been found advantageous to use cones whose base is about ¾ inch in diameter, with an angled taper of about 30 to 50 degrees, in conjunction with a cone height of about ¼ to ½ inch.

While the LED reflecting device 68 can be made from a reflective metal, certain advantages have been found in forming it from a plastic material, for example, polystyrene, and metalizing the surface by means of techniques well known in the art. Once formed and covered with the translucent film 76, appropriate numbers can be superimposed over the cones to provide highly visible, illuminated numbers.

FIG. 11 shows a plan view of the LED reflecting device 68 of FIG. 10. The Figure shows reflecting cones 70, including LED access holes 80 therein, interconnected by reinforcement partitions 74, and by base plate 72. While a generally rectangular matrix pattern is illustrated in the Figure, other patterns may also be provided as desired. For the bingo game board displays utilizing the LED reflecting devices 68, the devices are advantageously fabricated in the form of 4 to 5 inch squares, although other dimensions can be selected, if desired.

While in accordance with the palenl statutes, a preferred embodiment and best mode has been presented, the scope of the invention is not limited thereto, but rather is measured by the scope of the attached claims.

What is claimed is:

1. An electronic bingo game system network comprising in combination:

a master control station circuit;

table relay station circuits, and a cashier station circuit, said station circuits being electronically interconnected, wherein said master control station circuit includes means to sequentially select random bingo game numbers as well as means to transmit signals representing said numbers to said player station circuits through said table station circuits, and wherein said player table station circuits have electronically programmed visual display means representing bingo cards with uniquely numbered bingo matrices, said player table station circuits also having means to transmit through said table station circuits to said master control station circuit the amount of wagers placed by the insertion of coins or tokens and means to operate controls associated with said player table station circuits, as well as means to indicate the first completion of a predetermined winning pattern of said selected numbers, said master control station circuit also having means to verify the occurrence of said completions, means wherein said means to indicated the first completion of said winning pattern will automatically be transmitted to said means to verify the occurrence of said completion, to calculate the winnings due therefor on a pyramidal basis, as well as means to determine the status of players' accounts, and means to transmit totals due players to said cashier circuit upon operation of said means to operate controls associated with said player table station circuits by a player.

2. An electronic bingo game system network with interconnected electronic components comprising:
a master control station;
dual module player table stations;
table relay stations, and
a cashier station,
wherein said master control station comprises a display board and a control board, said display board comprising:
a microcontroller;
an LED driver circuit;
an LED display;
a serial transmission circuit, and
a power-up circuit,
said control board comprising:
a microcontroller;
a command switch driver circuit;
a memory circuit;
a serial transmission circuit, and
a power-up circuit,
and wherein said player table relay station comprises:
a microcontroller;
a serial transmission circuit, and
a power-up circuit,
and wherein further, said dual module player table stations comprise:
a microcontroller;
dual token scanner circuits;
dual analog to digital conversion circuits;
dual scanner calibration circuits;
dual player control circuits;
dual player identification circuits;
a serial transmission circuit;
an LED display driver circuit;
dual LED displays, and
a power-up circuit,
and wherein still further, said cashier station comprises:
a printer, and
a printer driver circuit.

3. A network according to claim 2 in which said microcontrollers are provided with standby battery power automatically supplied in the event of failure of the principal power source.

4. A network according to claim 2 which includes a plurality of interconnected groups of dual module table sections, each group containing eight said stations, and each said group being interconnected with a table relay station.

5. A network according to claim 2 in which each module of said player table station includes a buzzer circuit.

6. A network according to claim 2 in which said serial transmission circuits contain an electronic printed circuit chip of a type designated DS3695, or its equivalent, and in which said analog to digital conversion circuit contains an electronic printed circuit chip of a type designated ADC0804, or its equivalent.

7. An electronic bingo game system network with interconnected electronic components comprising:
a master control station;
dual module player table stations;
table relay stations, and
a cashier station,
wherein said master control station comprises a display board and a control board, said display board comprising:
a microcontroller;
an LED driver circuit;
an LED display;
a serial transmission circuit, and
a power-up circuit,
said control board comprising:
a microcontroller;
a command switch driver circuit;
a memory circuit;
a serial transmission circuit, and
a power-up circuit,
and wherein said player table relay station comprises:
a microcontroller;
a serial transmission circuit, and
a power-up circuit,
and wherein further, said dual module player table station comprises:
a microcontroller;
dual token scanner circuits;
dual analog to digital conversion circuits;
dual scanner calibration circuits;
dual player control circuits;
dual player identification circuits;
a serial transmission circuit;
an LED display driver circuit;
dual LED displays, and
a power-up circuit,
and wherein still further, said cashier station comprises:
a printer, and
a printer driver circuit,
and wherein still further, each module of said player table station is provided with a token receiver, and each module of said player table station has a restricted access depository for the collection of inserted tokens.

8. An electronic bingo game system network with interconnected electronic components comprising:
a master control station;
dual module player table stations;
table relay stations, and
a cashier station,
wherein said master control station comprises a display board and a control board, said display board comprising:
a microcontroller;
an LED driver circuit;
an LED display;
a serial transmission circuit, and
a power-up circuit,
said control board comprising:
a microcontroller;
a command switch driver circuit;
a memory circuit;
a serial transmission circuit, and
a power-up circuit,
and wherein said player table relay station comprises:
a microcontroller;
a serial transmission circuit, and
a power-up circuit,
and wherein further, said dual module player table station comprises:
a microcontroller;
dual token scanner circuits;
dual analog to digital conversion circuits;
dual scanner calibration circuits;
dual player control circuits;
dual player identification circuits;
a serial transmission circuit;
an LED display driver circuit;

dual LED displays, and a power-up circuit, and wherein still further, said cashier station comprises:

a printer, and a printer driver circuit, and wherein still further, each module of said player table station is provided with a token receiver, and each module of said player table station has a restricted access depository for the collection of inserted tokens, and in which said LED displays are provided with an LED reflecting device comprising a plurality of truncated, hollow, metalized reflector cones aligned in the same plane, said cones being positioned and interconnected to form a desired pattern, each of said cones having a hole at its apex adapted for insertion of an LED therein, while the bases of said cones are covered with a translucent film.

* * * * *